US010151513B2

(12) United States Patent
Liang et al.

(10) Patent No.: US 10,151,513 B2
(45) Date of Patent: Dec. 11, 2018

(54) EXPANSION COMPRESSOR APPARATUS AND AIR CONDITIONER HAVING THE SAME

(71) Applicant: GREE GREEN REFRIGERATION TECHNOLOGY CENTER CO., LTD. OF ZHUHAI, Zhuhai, Guangdong (CN)

(72) Inventors: Zhili Liang, Zhuhai (CN); Yusheng Hu, Zhuhai (CN); Jia Xu, Zhuhai (CN); Liping Ren, Zhuhai (CN)

(73) Assignee: GREE GREEN REFRIGERATION TECHNOLOGY CENTER CO., LTD. OF ZHUHAI, Zhuhai, Guangdong (CN)

( * ) Notice: Subject to any disclaimer, the term of this patent is extended or adjusted under 35 U.S.C. 154(b) by 121 days.

(21) Appl. No.: 15/032,984

(22) PCT Filed: Jul. 8, 2014

(86) PCT No.: PCT/CN2014/081848

§ 371 (c)(1),
(2) Date: Apr. 28, 2016

(87) PCT Pub. No.: WO2015/062307

PCT Pub. Date: May 7, 2015

(65) Prior Publication Data

US 2016/0282019 A1 Sep. 29, 2016

(30) Foreign Application Priority Data

Oct. 28, 2013 (CN) ..... 2013 1 0518182

(51) Int. Cl.

| | |
|---|---|
| ***F01C 1/30*** | (2006.01) |
| ***F25B 1/04*** | (2006.01) |
| ***F04C 23/00*** | (2006.01) |
| ***F04C 29/00*** | (2006.01) |

(Continued)

(52) U.S. Cl.
CPC ..... *F25B 1/04* (2013.01); *F01C 1/30* (2013.01); *F04C 18/0215* (2013.01);
(Continued)

(58) Field of Classification Search
CPC .... F01C 1/30; F04C 18/0215; F04C 18/3564; F04C 2240/60; F04C 23/003; F04C 23/02; F04C 29/0021; F25B 1/04
See application file for complete search history.

(56) References Cited

U.S. PATENT DOCUMENTS 5,775,883 A * 7/1998 Hattori ..... F01C 1/3564 417/292
8,245,528 B2 * 8/2012 Sakitani ..... F04C 23/003 62/468

FOREIGN PATENT DOCUMENTS

CN 102840139 A 12/2012
CN 102927714 A 2/2013
(Continued)

OTHER PUBLICATIONS

International Search Report dated Sep. 2, 2014.
(Continued)

*Primary Examiner* — Audrey K Bradley
*Assistant Examiner* — Anthony Ayala Delgado
(74) *Attorney, Agent, or Firm* — Li & Cai Intellectual Property (USA) Office

(57) ABSTRACT

The invention discloses an expansion compressor apparatus and an air conditioner having the same, wherein the expansion compressor apparatus includes: an expansion cylinder, a compression cylinder, and a connecting shaft, an expansion cylinder air suction passage communicated with an air suction cavity of the expansion cylinder being provided on the expansion cylinder, the expansion compressor apparatus further includes: a control cylinder, the control cylinder
(Continued)

being provided with a control cylinder air suction passage and a control cylinder air exhaust passage, both the control cylinder air suction passage and the control cylinder air exhaust passage being provided in a radial direction of the control cylinder, and a communication passage being provided between the control cylinder air exhaust passage and the expansion cylinder air suction passage. The apparatus effectively solves the problem in the prior art that a high-pressure fluid exerts an impact force in an axial direction on a fan-shaped cam.

14 Claims, 3 Drawing Sheets

(51) Int. Cl.
*F04C 18/356* (2006.01)
*F04C 18/02* (2006.01)
*F04C 23/02* (2006.01)

(52) U.S. Cl.
CPC ..... *F04C 18/3564* (2013.01); *F04C 23/003* (2013.01); *F04C 29/0021* (2013.01); *F04C 23/02* (2013.01); *F04C 2240/60* (2013.01)

(56) References Cited

FOREIGN PATENT DOCUMENTS

| | | | |
|---|---|---|---|
| CN | 103105022 | A | 5/2013 |
| EP | 2133512 | A1 | 12/2009 |
| JP | 2011241765 | A | 12/2011 |
| WO | WO 2013065140 | A1 | 5/2013 |

OTHER PUBLICATIONS

European Patent Office, Extended European Patent Search Report dated Jun. 14, 2017 regarding the European counterpart patent application of the present application.
Korea Patent Office, First Examination Report dated Dec. 14, 2017 regarding the Korean counterpart patent application of the present application.
Japan Patent Office, First Office Action dated Feb. 21, 2017 regarding the Japan counterpart patent application of the present application.

* cited by examiner

EXPANSION COMPRESSOR APPARATUS AND AIR CONDITIONER HAVING THE SAME

TECHNICAL FIELD OF THE INVENTION

The invention relates to the technical field of air conditioners, and in particular to an expansion compressor apparatus and an air conditioner having the same.

BACKGROUND OF THE INVENTION

Currently, an expander and a compressor in an air conditioner are connected via a shaft, and the compressor is driven by means of power recovered from air expanded in the expander.

In the prior art, fluid machinery includes the expander and the compressor, wherein the expander is provided with an expander suction hole and an expander exhaust hole, and the compressor is provided with a compressor suction hole and a compressor exhaust hole. When a refrigeration circulating apparatus is started, the fluid machinery without a drive apparatus can be reliably self-started only under the pressure of a working fluid. When the fluid machinery is in a working state, the expander suction hole and the compressor suction hole are closed along with the rotation of the shaft. Specifically, during the closing period of the compressor suction hole, the expander suction hole is in an open state; and during the closing period of the expander suction hole, the compressor suction hole is in an open state and is not communicated with the compressor exhaust hole.

Since the expander suction hole is provided at a bottom of a lower bearing and a high-pressure fluid fed from the bottom exerts an upward impact force on a fan-shaped cam of a crankshaft, the axial movement of the crankshaft is increased, thereby making an expansion compressor operate unstably. An expander air suction control mode has a potential safety hazard of low reliability, with the accumulation of operating time, the abrasion of a cam in the air suction control mode is increased, a clearance between an upper end surface of the cam and a lower end surface of an expansion cylinder is enlarged, and seal failure is caused accordingly, thereby making it unable to perform air suction control. The structure of the expander is relatively complicated, and the expander is difficult to process.

SUMMARY OF THE INVENTION

The invention aims to provide an expansion compressor apparatus and an air conditioner having the same, which are intended to solve the problem in the prior art that a high-pressure fluid exerts an impact force in an axial direction on a fan-shaped cam.

In order to achieve the aim, according to one aspect of the invention, an expansion compressor apparatus is provided, which comprising: an expansion cylinder, a compression cylinder, and a connecting shaft connecting the expansion cylinder and the compression cylinder. An expansion cylinder air suction passage communicated with an air suction cavity of the expansion cylinder being provided on the expansion cylinder, and the expansion cylinder air suction passage being provided in a radial direction of the expansion cylinder. The expansion compressor apparatus further comprising: a control cylinder. The connecting shaft passes through the control cylinder. and is provided in the control cylinder, the control cylinder being provided with a control cylinder air suction passage and a control cylinder air exhaust passage, both the control cylinder air suction passage and the control cylinder air exhaust passage being provided in a radial direction of the control cylinder, and a communication passage being provided between the control cylinder air exhaust passage and the expansion cylinder air suction passage. A communication groove being provided at a position, corresponding to the control cylinder, on the connecting shaft, and the communication groove rotating along with the connecting shaft to enable the control cylinder air suction passage and the control cylinder air exhaust passage to be communicated or separated.

Furthermore, the expansion cylinder further comprising an expansion roller, the expansion roller is provided on an expansion eccentric portion of the connecting shaft in a sleeving manner, the expansion cylinder is provided with a first inner hole, the expansion roller eccentrically rotates in the first inner hole, an expansion cylinder air exhaust passage communicated with an air exhaust cavity of the expansion cylinder is provided on the expansion cylinder and is provided in the radial direction of the expansion cylinder, a sliding slot extending in the radial direction of the expansion cylinder is provided between the expansion cylinder air suction passage and the expansion cylinder air exhaust passage, an expansion sliding sheet is provided in the sliding slot and abuts against the expansion roller, and the air suction cavity of the expansion cylinder and the air exhaust cavity of the expansion cylinder are formed between the first inner hole and the expansion roller.

Furthermore, an included angle between one side, in a width direction, of the expansion cylinder air suction passage and a length direction of the expansion sliding sheet is an expansion cylinder air suction front-edge angle $\beta$, and an included angle between the other side, in the width direction, of the expansion cylinder air suction passage and the length direction of the expansion sliding sheet is an expansion cylinder air suction rear-edge angle $\alpha$. An included angle between one side, in a width direction, of the expansion cylinder air exhaust passage and the length direction of the expansion sliding sheet is an expansion cylinder air exhaust front-edge angle $\Phi$, and an included angle between the other side, in the width direction, of the expansion cylinder air exhaust passage and the length direction of the expansion sliding sheet is an expansion cylinder air exhaust rear-edge angle $\gamma$. An included angle between one side, away from the control cylinder air exhaust passage in a clockwise direction, of the control cylinder air suction passage and a central line of the expansion eccentric portion is $\delta$. Wherein the expansion cylinder air suction front-edge angle $\beta$, the expansion cylinder air suction rear-edge angle $\alpha$, the expansion cylinder air exhaust front-edge angle $\Phi$, the expansion cylinder air exhaust rear-edge angle $\gamma$ and the included angle $\delta$ satisfy at least one of the following relations: $\beta>\alpha$; $\gamma>\Phi$; and $-90°\leq\delta\leq 90°$.

Furthermore, the control cylinder further comprises a concentric piston coaxial with the connecting shaft, the control cylinder is provided with a second inner hole, the concentric piston is provided rotatably in the second inner hole, and the communication groove is formed in the concentric piston.

Furthermore, a clearance between an outer diameter of the concentric piston and an inner diameter of the second inner hole of the control cylinder is within a range of 0 to 0.1 mm.

Furthermore, the clearance between the concentric piston and the second inner hole of the control cylinder is sealed by an oil film.

Furthermore, the control cylinder is provided on one side, away from the compression cylinder, of the expansion cylinder.

Furthermore, the communication groove is an arc-shaped groove extending in a circumferential direction of the connecting shaft.

Furthermore, a radian angle formed by the arc-shaped groove is θ, θ being within a range of 0° to 360°−γ.

According to another aspect of the invention, an air conditioner is provided, which has an expansion compressor apparatus. The expansion compressor apparatus is an above-mentioned expansion compressor apparatus.

By means of the technical solutions of the invention, high-pressure air enters the control cylinder air suction passage, and since the communication groove rotates along with the connecting shaft, when the control cylinder air suction passage and the control cylinder air exhaust passage are communicated via the communication groove, the expansion cylinder starts to suck air. Specifically, the high-pressure air passes through the control cylinder air suction passage, the communication groove and the control cylinder air exhaust passage in sequence, and then enters the expansion cylinder air suction passage, and the expansion cylinder starts to suck air, namely an air suction process of the expansion cylinder is started. Since both the control cylinder air suction passage and the control cylinder air exhaust passage are provided in the radial direction of the control cylinder, when entering the control cylinder, the high-pressure air will not exert an axial impact on the expansion eccentric portion, so that the expansion compressor apparatus operates more stably, thereby improving the reliability of an air suction control mode of the expansion compressor apparatus.

BRIEF DESCRIPTION OF THE DRAWINGS

The specification drawings forming a part of the invention are intended to provide further understanding of the invention. The schematic embodiments and descriptions of the invention are intended to explain the invention, and do not form improper limits to the invention. In the drawings.

Figure 1:
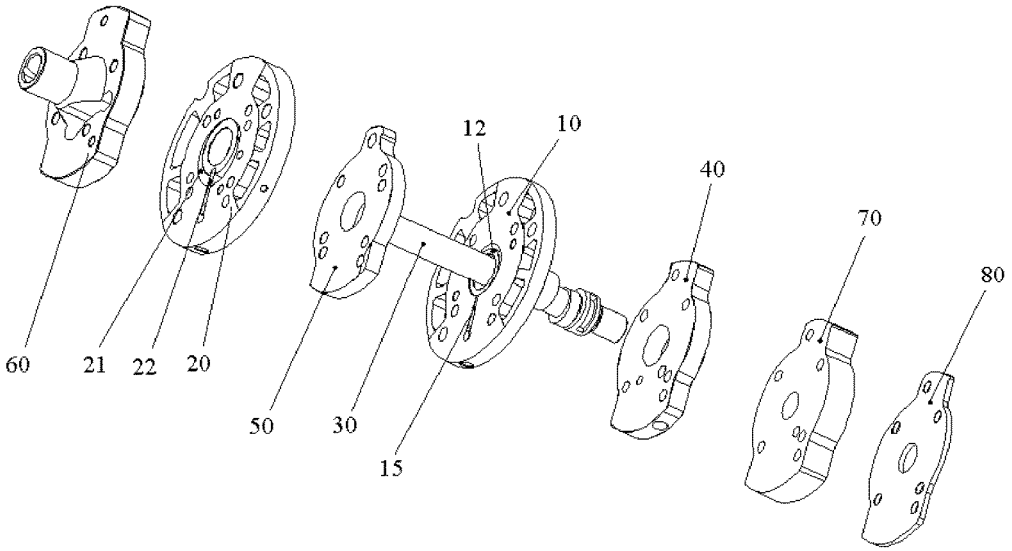
FIG. 1 shows a breakdown structure diagram of an expansion compressor apparatus according to an embodiment of the invention.
Figure 2:
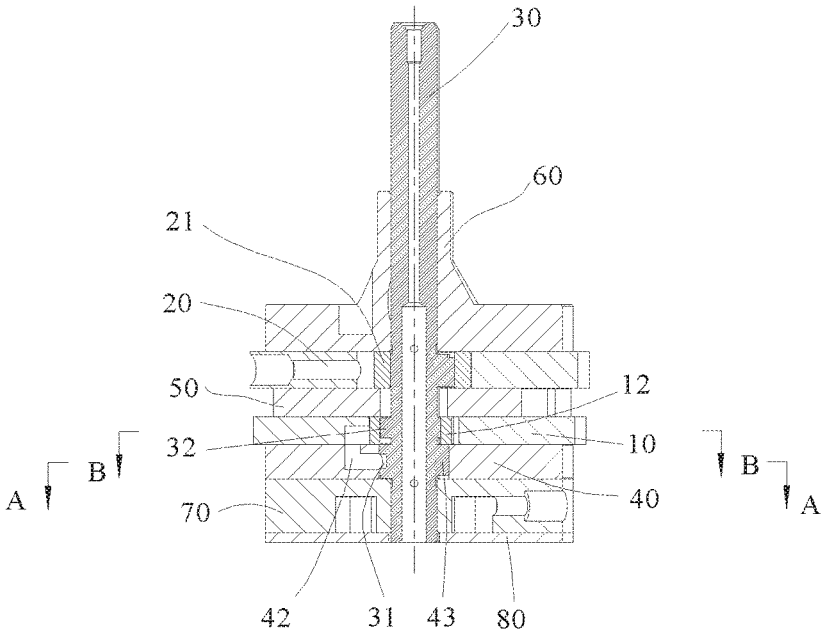
FIG. 2 shows a longitudinal section diagram of an expansion compressor apparatus in FIG. 1.
Figure 3:
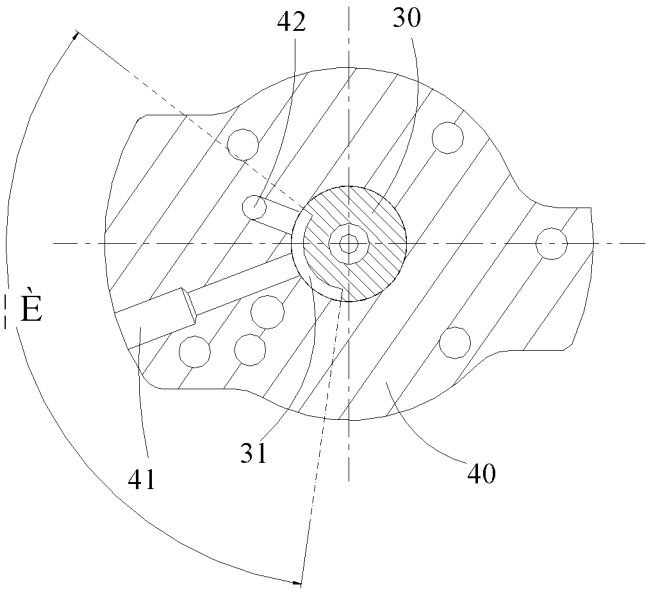
FIG. 3 shows an A-A direction section diagram of an expansion compressor apparatus in FIG. 2.
Figure 4:
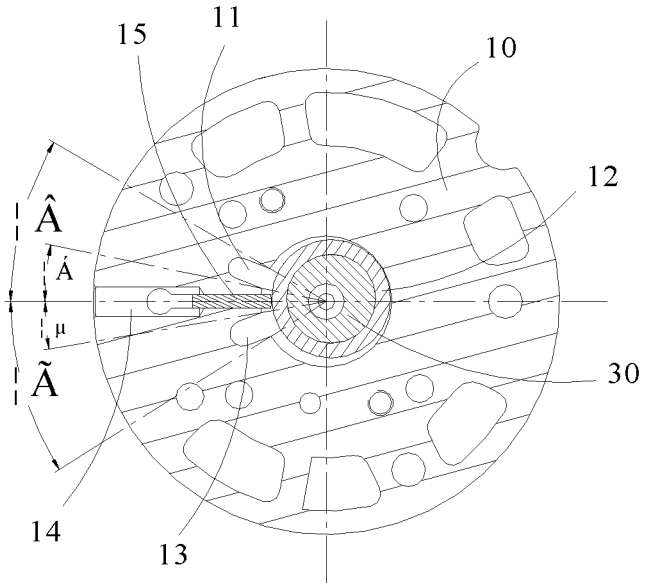
FIG. 4 shows a B-B direction section diagram of an expansion compressor apparatus in FIG. 2.

The drawings include the following drawing marks:

10, expansion cylinder; 11, expansion cylinder air suction passage; 12, expansion roller; 13, expansion cylinder air exhaust passage; 14, sliding slot; 15, expansion sliding sheet; 20, compression cylinder; 21, compression roller; 22, compression sliding sheet; 30, connecting shaft; 31, arc-shaped groove; 32, expansion eccentric portion; 40, control cylinder; 41, control cylinder air suction passage; 42, control cylinder air exhaust passage; 43, concentric piston; 50, partition plate; 60, upper flange; 70, lower flange; and 80, end cover plate.

DETAILED DESCRIPTION OF THE EMBODIMENTS

It is important to note that the embodiments of the invention and the characteristics in the embodiments can be combined under the condition of no conflicts. The invention is described below with reference to the drawings and the embodiments in detail.

As shown in FIG. 1 to FIG. 4, an expansion compressor apparatus according to an embodiment comprises an expansion cylinder 10, a compression cylinder 20, a connecting shaft 30 and a control cylinder 40. The connecting shaft 30 connects the expansion cylinder 10 and the compression cylinder 20, an expansion cylinder air suction passage 11 communicated with an air suction cavity of the expansion cylinder 10 is provided on the expansion cylinder 10 and is provided in a radial direction of the expansion cylinder 10, the connecting shaft 30 passes through the control cylinder 40, and is provided in the control cylinder 40, the control cylinder 40 is provided with a control cylinder air suction passage 41 and a control cylinder air exhaust passage 42, both the control cylinder air suction passage 41 and the control cylinder air exhaust passage 42 are provided in a radial direction of the control cylinder 40, a communication passage is provided between the control cylinder air exhaust passage 42 and the expansion cylinder air suction passage 11, the connecting shaft 30 passes through the control cylinder 40, and is provided in the control cylinder 40, a communication groove is provided at a position, corresponding to the control cylinder 40, on the connecting shaft 30, and the communication groove rotates along with the connecting shaft 30 to enable the control cylinder air suction passage 41 and the control cylinder air exhaust passage 42 to be communicated or separated.

By means of the expansion compressor apparatus according to the embodiment, high-pressure air enters the control cylinder air suction passage 41, and since the communication groove rotates along with the connecting shaft 30, when the control cylinder air suction passage 41 and the control cylinder air exhaust passage 42 are communicated via the communication groove, the expansion cylinder 10 starts to suck air. Specifically, the high-pressure air passes through the control cylinder air suction passage 41, the communication groove and the control cylinder air exhaust passage 42 in sequence, and then enters the expansion cylinder air suction passage 11, and the expansion cylinder 10 starts to suck air, namely an air suction process of the expansion cylinder 10 is started. Since both the control cylinder air suction passage 41 and the control cylinder air exhaust passage 42 are provided in the radial direction of the control cylinder 40, when entering the control cylinder 40, the high-pressure air will not exert an axial impact on the expansion eccentric portion 32, so that the expansion compressor apparatus operates more stably, thereby improving the reliability of an air suction control mode of the expansion compressor apparatus.

Figure 5:
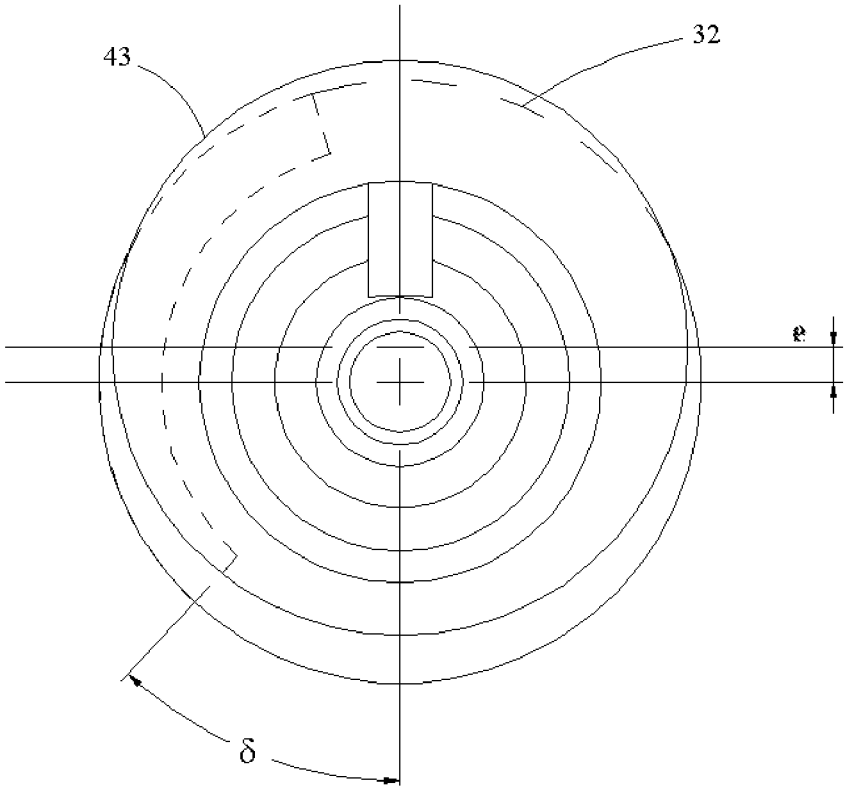
FIG. 5 shows a partial structure diagram of an expansion compressor apparatus in FIG. 2.

In the embodiment, the expansion cylinder 10 further comprises an expansion roller 12, the expansion roller 12 is provided on an expansion eccentric portion 32 of the connecting shaft 30 in a sleeving manner, the expansion cylinder 10 is provided with a first inner hole, the expansion roller 12 eccentrically rotates in the first inner hole, an expansion cylinder air exhaust passage 13 communicated with an air exhaust cavity of the expansion cylinder 10 is provided on the expansion cylinder 10 and is provided in the radial direction of the expansion cylinder 10, a sliding slot 14 extending in the radial direction of the expansion cylinder 10 is provided between the expansion cylinder air suction passage 11 and the expansion cylinder air exhaust passage 13, an expansion sliding sheet 15 is provided in the sliding slot 14 and abuts against the expansion roller 12, and the air suction cavity of the expansion cylinder 10 and the air exhaust cavity of the expansion cylinder 10 are formed between the first inner hole and the expansion roller 12. As shown in FIG. 5, an expansion eccentricity of the expansion eccentric portion 32 deviating from a concentric piston 43 is e.

A working process of the expansion cylinder 10 is as follows.

The high-pressure air enters the control cylinder air suction passage 41, and since the communication groove rotates along with the connecting shaft 30, when the control cylinder air suction passage 41 and the control cylinder air exhaust passage 42 are communicated, after the expansion roller 12 turns for an expansion cylinder air suction front-edge angle β, the high-pressure air passes through the control cylinder air suction passage 41, the communication groove and the control cylinder air exhaust passage 42 in sequence, and then enters the expansion cylinder air suction passage 11, and the expansion cylinder 10 starts to suck air, namely the air suction process of the expansion cylinder 10 is started. One end, reaching the control cylinder air suction passage 41 firstly, of the communication groove rotating along with the connecting shaft 30 is a head end. When a tail end of the communication groove departs from the control cylinder air suction passage 41, the air suction process of the expansion cylinder 10 is ended, and at this time, the expansion cylinder 10 starts to expand. When the expansion roller 12 turns for an expansion cylinder air exhaust rear-edge angle γ, the expansion of the expansion cylinder 10 is ended, and the expansion cylinder air exhaust passage 13 starts to exhaust the air. When the expansion roller 12 turns for 720°−γ, the air exhaust of the expansion cylinder 10 is ended.

In the embodiment, an included angle between one side, in a width direction, of the expansion cylinder air suction passage 11 and a length direction of the expansion sliding sheet 15 is the expansion cylinder air suction front-edge angle β, and an included angle between the other side, in the width direction, of the expansion cylinder air suction passage 11 and the length direction of the expansion sliding sheet 15 is an expansion cylinder air suction rear-edge angle α. An included angle between one side, in a width direction, of the expansion cylinder air exhaust passage 13 and the length direction of the expansion sliding sheet 15 is an expansion cylinder air exhaust front-edge angle Φ, and an included angle between the other side, in the width direction, of the expansion cylinder air exhaust passage 13 and the length direction of the expansion sliding sheet 15 is the expansion cylinder air exhaust rear-edge angle γ. An included angle between one side, away from the control cylinder air exhaust passage 42 in a clockwise direction, of the control cylinder air suction passage 41 and a central line of the expansion eccentric portion 32 is δ. The expansion cylinder air suction front-edge angle β, the expansion cylinder air suction rear-edge angle α, the expansion cylinder air exhaust front-edge angle Φ, the expansion cylinder air exhaust rear-edge angle γ and the included angle δ satisfy at least one of the following relations: $\beta>\alpha$; $\gamma>\Phi$; and $-90°\leq\delta\leq 90°$. In order to prevent expansions insufficiency, an air suction capacity of the expansion cylinder 10 is ensured, namely an expansion ratio of the expansion cylinder 10 is ensured, and δ should be greater than or equal to −90° and should be less than or equal to 90°.

In the embodiment, the control cylinder 40 further comprises the concentric piston 43 coaxial with the connecting shaft 30, the control cylinder 40 is provided with a second inner hole, the concentric piston 43 is provided rotatably in the second inner hole, and a clearance between an outer diameter of the concentric piston 43 and an inner diameter of the second inner hole of the control cylinder 40 is within a range of 0 to 0.1 mm. In the embodiment, the clearance between the outer diameter of the concentric piston 43 and the second inner hole of the control cylinder 40 is sealed by an oil film. The oil film can prevent a phenomenon of movement of high-pressure air outside the concentric piston 43 between the control cylinder air suction passage 41 and the control cylinder air exhaust passage 42, the phenomenon referring to a phenomenon of heat movement. The clearance between the outer diameter of the concentric piston 43 and the second inner hole of the control cylinder 40 is 0.015 mm. When the expansion compressor apparatus operates, the clearance is filled with refrigerant oil, thereby achieving a good seal effect.

In the embodiment, the control cylinder 40 is provided on one side, away from the compression cylinder 20, of the expansion cylinder 10. The structure is simple, and mounting is convenient.

In the embodiment, the compression cylinder 20 comprises a compression roller 21 and a compression sliding sheet 22, the compression roller 21 is provided on the connecting shaft 30 in a penetration manner, the compression cylinder 20 is provided with a third inner hole matched with the compression roller 21 and the compression cylinder 20 is also provided with a second radial hole which accommodates the compression sliding sheet 22 and penetrates in a radial direction of the compression cylinder 20, the compression sliding sheet 22 abuts against the compression roller 21, and a compression cylinder air suction cavity and a compression cylinder suction cavity are formed between the third inner hole of the compression cylinder 20 and the compression roller 21.

In the embodiment, the expansion compressor apparatus further comprises a partition plate 50, an upper flange 60, a lower flange 70 and an end cover plate 80, wherein the partition plate 50 is provided between the compression cylinder 20 and the expansion cylinder 10; the upper flange 60 is provided on one side, away from the expansion cylinder 10, of the compression cylinder 20; the lower flange 70 is provided on one side, away from the compression cylinder 20, of the control cylinder 40; and the end cover plate 80 is provided on one side, away from the expansion cylinder 10, of the lower flange 70. In the embodiment, the connecting shaft 30 is provided with a through hole which penetrates in an axial direction of the connecting shaft 30.

In the embodiment, the communication groove is an arc-shaped groove 31 extending in a circumferential direction of the connecting shaft 30. Certainly, the communication groove may be of other shapes. In the embodiment, a radian angle formed by the arc-shaped groove 31 is θ, θ being within a range of 0° to 360°−γ. Air suction starting time and air suction ending time of the expansion cylinder 10 can be adjusted by adjusting θ, and the air suction capacity of the expansion cylinder 10 can be further adjusted, namely the expansion ratio of the expansion cylinder 10 can be adjusted. Preferably, θ is 120°, and δ is 43°.

The invention also provides an air conditioner. An embodiment (unmarked in Figure) for the air condition in the embodiment has an expansion compressor apparatus. The expansion compressor apparatus is an above-mentioned expansion compressor apparatus. High-pressure air enters a control cylinder air suction passage 41, and since a communication groove rotates along with a connecting shaft 30, when the control cylinder air suction passage 41 and a control cylinder air exhaust passage 42 are communicated via the communication groove, an expansion cylinder 10 starts to suck air. Specifically, the high-pressure air passes through the control cylinder air suction passage 41, the communication groove and the control cylinder air exhaust passage 42 in sequence, and then enters an expansion cylinder air suction passage 11, and the expansion cylinder 10 starts to suck air, namely an air suction process of the expansion cylinder 10 is started. Since both the control cylinder air suction passage 41 and the control cylinder air exhaust passage 42 are provided in the radial direction of a control cylinder 40, when entering the control cylinder 40, the high-pressure air will not exert an axial impact on an expansion eccentric portion 32, so that the expansion compressor apparatus operates more stably, thereby improving the reliability of an air suction control mode of the expansion compressor apparatus.

The above is only the preferred embodiments of the invention, and is not intended to limit the invention. There can be various modifications and variations in the invention for those skilled in the art. Any modifications, equivalent replacements, improvements and the like within the spirit and principle of the invention shall fall within the protection scope of the invention.

The invention claimed is:

1. An expansion compressor apparatus, comprising: an expansion cylinder (10), a compression cylinder (20), and a connecting shaft (30) connecting the expansion cylinder (10) and the compression cylinder (20), an expansion cylinder air suction passage (11) communicated with an air suction cavity of the expansion cylinder (10) being provided on the expansion cylinder (10), and the expansion cylinder air suction passage (11) being provided in a radial direction of the expansion cylinder (10);

the expansion compressor apparatus further comprising:

a control cylinder (40), the connecting shaft (30) passes through the control cylinder (40), and is provided in the control cylinder (40), the control cylinder (40) being provided with a control cylinder air suction passage (41) and a control cylinder air exhaust passage (42), both the control cylinder air suction passage (41) and the control cylinder air exhaust passage (42) being provided in a radial direction of the control cylinder (40), and a communication passage being provided between the control cylinder air exhaust passage (42) and the expansion cylinder air suction passage (11), wherein the control cylinder (40) further comprises a concentric piston (43) coaxial with the connecting shaft (30), the control cylinder (40) is provided with a second inner hole, the concentric piston (43) is provided rotatably in the second inner hole, and the communication groove is formed in the concentric piston (43), a clearance between an outer diameter of the concentric piston (43) and an inner diameter of the second inner hole of the control cylinder (40) is within a range of 0 to 0.1 mm;

a communication groove being provided at a position, corresponding to the control cylinder (40), on the connecting shaft (30), and the communication groove rotating along with the connecting shaft (30) to enable the control cylinder air suction passage (41) and the control cylinder air exhaust passage (42) to be communicated or separated.

2. The expansion compressor apparatus according to claim 1, wherein the expansion cylinder (10) further comprises an expansion roller (12), the expansion roller (12) is provided on an expansion eccentric portion (32) of the connecting shaft (30) in a sleeving manner, the expansion cylinder (10) is provided with a first inner hole, the expansion roller (12) eccentrically rotates in the first inner hole, an expansion cylinder air exhaust passage (13) communicated with an air exhaust cavity of the expansion cylinder (10) is provided on the expansion cylinder (10) and is provided in the radial direction of the expansion cylinder (10), a sliding slot (14) extending in the radial direction of the expansion cylinder (10) is provided between the expansion cylinder air suction passage (11) and the expansion cylinder air exhaust passage (13), an expansion sliding sheet (15) is provided in the sliding slot (14) and abuts against the expansion roller (12), and the air suction cavity of the expansion cylinder (10) and the air exhaust cavity of the expansion cylinder (10) are formed between the first inner hole and the expansion roller (12).

3. The expansion compressor apparatus according to claim 2, wherein an included angle between one side, in a width direction, of the expansion cylinder air suction passage (11) and a length direction of the expansion sliding sheet (15) is an expansion cylinder air suction front-edge angle $\beta$, and an included angle between the other side, in the width direction, of the expansion cylinder air suction passage (11) and the length direction of the expansion sliding sheet (15) is an expansion cylinder air suction rear-edge angle $\alpha$;

an included angle between one side, in a width direction, of the expansion cylinder air exhaust passage (13) and the length direction of the expansion sliding sheet (15) is an expansion cylinder air exhaust front-edge angle $\Phi$, and an included angle between the other side, in the width direction, of the expansion cylinder air exhaust passage (13) and the length direction of the expansion sliding sheet (15) is an expansion cylinder air exhaust rear-edge angle $\gamma$;

an included angle between one side, away from the control cylinder air exhaust passage (42) in a clockwise direction, of the control cylinder air suction passage (41) and a central line of the expansion eccentric portion (32) is $\delta$; and the expansion cylinder air suction front-edge angle $\beta$, the expansion cylinder air suction rear-edge angle $\alpha$, the expansion cylinder air exhaust front-edge angle $\Phi$, the expansion cylinder air exhaust rear-edge angle $\gamma$ and the included angle $\delta$ satisfy at least one of the following relations:

$$\beta>\alpha;$$

$$\gamma>\Phi; \text{ and}$$

$$-90^\circ\leq\delta\leq90^\circ.$$

4. The expansion compressor apparatus according to claim 1, wherein the clearance between the concentric piston (43) and the second inner hole of the control cylinder (40) is sealed by an oil film.

5. The expansion compressor apparatus according to claim 1, wherein the control cylinder (40) is provided on one side, away from the compression cylinder (20), of the expansion cylinder (10).

6. The expansion compressor apparatus according to claim 3, wherein the communication groove is an arc-shaped groove (31) extending in a circumferential direction of the connecting shaft (30).

7. The expansion compressor apparatus according to claim 6, wherein a radian angle formed by the arc-shaped groove (31) is θ, θ being within a range of 0° to 360°−γ.

8. An air conditioner, having an expansion compressor apparatus, wherein the expansion compressor apparatus is an expansion compressor apparatus according to claim 1.

9. An air conditioner, having an expansion compressor apparatus, wherein the expansion compressor apparatus is an expansion compressor apparatus according to claim 2.

10. An air conditioner, having an expansion compressor apparatus, wherein the expansion compressor apparatus is an expansion compressor apparatus according to claim 3.

11. An air conditioner, having an expansion compressor apparatus, wherein the expansion compressor apparatus is an expansion compressor apparatus according to claim 4.

12. An air conditioner, having an expansion compressor apparatus, wherein the expansion compressor apparatus is an expansion compressor apparatus according to claim 5.

13. An air conditioner, having an expansion compressor apparatus, wherein the expansion compressor apparatus is an expansion compressor apparatus according to claim 6.

14. An air conditioner, having an expansion compressor apparatus, wherein the expansion compressor apparatus is an expansion compressor apparatus according to claim 7.

* * * * *